US009745711B2

(12) United States Patent
Sluiter

(10) Patent No.: US 9,745,711 B2
(45) Date of Patent: Aug. 29, 2017

(54) PREFABRICATED WALL SYSTEM AND METHOD

(71) Applicant: Scott E. Sluiter, Holland, MI (US)

(72) Inventor: Scott E. Sluiter, Holland, MI (US)

( * ) Notice: Subject to any disclaimer, the term of this patent is extended or adjusted under 35 U.S.C. 154(b) by 0 days.

(21) Appl. No.: 15/186,915

(22) Filed: Jun. 20, 2016

(65) Prior Publication Data

US 2016/0369494 A1 Dec. 22, 2016

Related U.S. Application Data

(60) Provisional application No. 62/182,673, filed on Jun. 22, 2015.

(51) Int. Cl.

| | |
|---|---|
| ***E02D 27/32*** | (2006.01) |
| ***E04B 2/00*** | (2006.01) |
| ***E04B 5/10*** | (2006.01) |
| ***E04B 2/74*** | (2006.01) |

(52) U.S. Cl.

CPC ..... *E02D 27/32* (2013.01); *E04B 2/7453* (2013.01); *E04B 5/10* (2013.01); *E04C 2/46* (2013.01); *E04B 2002/7496* (2013.01)

(58) Field of Classification Search

CPC ..... E02D 27/32; E04B 2/7453; E04B 5/10; E04B 2002/7496; E04C 2/46

USPC ..... 52/127.3, 127.4, 274, 293.3, 514, 514.5, 52/742.14, 742.16, 745.1

See application file for complete search history.

(56) References Cited

U.S. PATENT DOCUMENTS

| | | | | | |
|---|---|---|---|---|---|
| 2,362,162 | A * | 11/1944 | Sheldon | E04B 1/6158 | 52/271 |
| 3,170,269 | A * | 2/1965 | Dunnington | E04B 1/08 | 52/293.3 |
| 3,334,455 | A * | 8/1967 | Russell | E04B 1/0007 | 411/116 |
| 3,623,288 | A * | 11/1971 | Horowitz | E04B 1/6812 | 52/264 |
| 5,201,786 | A * | 4/1993 | Larsen | E04B 1/06 | 52/223.7 |
| 7,293,392 | B2 * | 11/2007 | Krumbacher | E04B 2/7457 | 403/103 |
| 2012/0311955 | A1 * | 12/2012 | Johnson | E04B 1/10 | 52/656.9 |
| 2015/0267393 | A1 * | 9/2015 | Bovet | E04F 13/0866 | 52/126.3 |
| 2016/0222651 | A1 * | 8/2016 | MacKinlay | B32B 13/02 | |
| 2016/0369494 | A1 * | 12/2016 | Sluiter | E04C 2/46 | |

* cited by examiner

*Primary Examiner* — Brian Glessner
*Assistant Examiner* — Adam Barlow
(74) *Attorney, Agent, or Firm* — Warner Norcross & Judd LLP

(57) ABSTRACT

A system for installing prefabricated wall panels in a building includes a lower sill plate adapted to be fastened to a foundation, an upper sill plate fastened to a bottom of the prefabricated wall panel and adapted to be inserted within the lower sill plate, and a plurality of openings in the upper sill plate. The openings are adapted to allow grout to be inserted between the upper sill plate and the lower sill plate after the upper sill plate is inserted within the lower sill plate.

7 Claims, 5 Drawing Sheets

PREFABRICATED WALL SYSTEM AND METHOD

BACKGROUND OF THE INVENTION

The present invention relates to prefabricated wall systems, and more particularly to a system for easily installing prefabricated walls in a level manner, regardless of whether the existing foundation or base on which the wall is to be installed is uneven or not level.

Often times a prefabricated wall panel has more precise tolerances than the foundation on which the prefabricated wall panel is to be mounted. This means that the foundation may not be as straight as the wall panel, or may be slanted or uneven. Although such mismatches between the foundation and the wall panel are often tolerated in wood panel framing, they are desirably eliminated or reduced in light gauge metal framing. In the past, such mismatches have been eliminated or reduced in two general manners. First, builders may insert shims between the bottom of the wall panel and the top of the foundation, as necessary, in order to correct for any unevenness or unlevelness in the foundation. Second, builders may attempt to insert grout between the bottom of the wall panel and the top of the foundation. This second method is often undesirable because of the difficulty of preventing the grout from leaking out of its desired positioned prior to its curing, and/or because of the difficulty of completely inserting the grout into all of the gaps where its presence is desired.

SUMMARY OF THE INVENTION

According to some of the embodiments of the present invention, a system and method are provided for more easily addressing mismatches between prefabricated wall panels and the foundations on which they are mounted. In some embodiments, the system and method utilize upper and lower sill plates that enable grout to be easily inserted therebetween in all desired locations such that the grout does not escape prior to curing. The use of permanent shims is avoided and the prior difficulties of using grout are substantially avoided or reduced.

According to a first embodiment, a system for installing prefabricated wall panels is provided that includes a lower sill plate and an upper sill plate. The upper sill plate has a plurality of openings defined therein. The lower sill plate is adapted to be fastened to a foundation. The upper sill plate is fastened to a bottom of the prefabricated wall panel and is adapted to be inserted within the lower sill plate. The plurality of opening are adapted to allow grout to be inserted between the upper sill plate and the lower sill plate after the upper sill plate is inserted within the lower sill plate.

According to other aspects, the upper sill plate has a generally U-shaped cross section comprised of a horizontal member and two end members that are generally perpendicular to the horizontal member. The plurality of opening are defined in the horizontal member.

In some embodiments, the lower sill plate has a generally U-shaped cross section comprised of a horizontal member and two end members that are generally perpendicular to the horizontal member. The two end members extend vertically upward from the horizontal member when the lower sill plate is fastened to the foundation.

The lower sill plate includes a plurality of slits defined in the two end members, in some embodiments. The slits are adapted to allow the lower sill plate to bend in a manner that follows any undulations in a top surface of the foundation.

The lower sill plate is adapted to contain the grout such that the grout is generally prevented from escaping out of the lower sill plate prior to curing.

The upper sill plate is adapted to be fastened to the lower sill plate prior to the grout being inserted between the upper sill plate and the lower sill plate. The lower sill plate matches an upper surface of the foundation such that any lack of levelness or unevenness in the upper surface of the foundation is matched by the lower sill plate. The upper sill plate is adapted to be attached to the lower sill plate without matching any lack of levelness or uneveness in the upper surface of the foundation.

The upper and lower sill plates are made of metal and the prefabricated wall panel includes a plurality of metal wall studs, in at least some embodiments. The bottoms of the metal wall studs are attached to a top surface of the upper sill plate.

According to another embodiment, a method of installing a prefabricated wall panel on top of a foundation is provided. The method includes fastening a lower sill plate to a top of the foundation; inserting the prefabricated wall panel into the lower sill plate; leveling the prefabricated wall panel; fastening the prefabricated wall panel to the lower sill plate while the prefabricated wall panel is level; and inserting grout through one or more openings in a bottom of the prefabricated wall panel between a bottom of the prefabricated wall panel and a top of the lower sill plate.

The method may further include fastening an upper sill plate to the bottom of the prefabricated wall panel prior to inserting the prefabricated wall panel into the lower sill plate. The fastening of the lower sill plate to the top of the foundation includes bending the lower sill plate to match any unevenness or lack of levelness of the top of the foundation.

In some embodiments, the fastening of the prefabricated wall panel to the lower sill plate while the prefabricated wall panel is level includes inserting fasteners through a first vertical wall member of the lower sill plate and through a second vertical wall member of the upper sill plate.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE EMBODIMENTS

Figure 1:
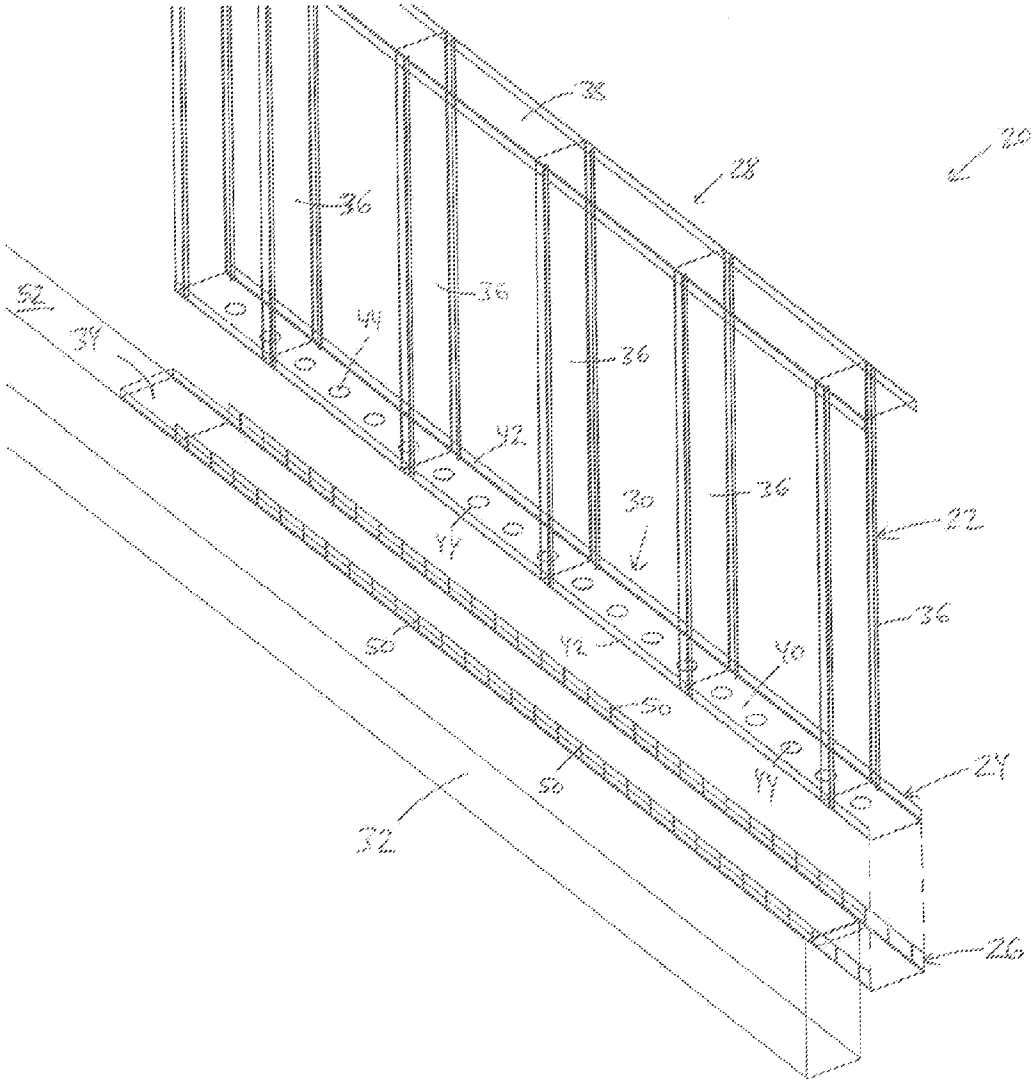
FIG. 1 is a perspective view of a first embodiment of a wall leveling system of the present invention shown coupled to a foundation.

A wall leveling system 20 according to one embodiment of the present invention is shown in FIG. 1. Wall leveling system 20 includes a prefabricated wall panel 22, an upper sill plate 24, and a lower sill plate 26. Prefabricated wall panel 22 includes a top 28 and a bottom 30. Upper sill plate 24 is secured to the bottom 30 of wall panel 22. Lower sill plate 26 is adapted to be attached to a foundation 32. Foundation 32 can take on a variety of different forms. In many instances, foundation 32 will be part of the ground level of a building, although it will be understood that foundation 32 may alternatively be part of an upper level (e.g. non-ground level) floor of a multi-story building.

When fully installed, wall leveling system 20 also typically includes a layer of grout 34 that is positioned on top of lower sill plate 26 and underneath upper sill plate 24. In FIG. 1, the grout 34 is drawn transparently so that lower sill plate 26 can be seen underneath it. In fact, all of the components of wall leveling system 20 have been illustrated transparently in FIGS. 1 and 2 so that all of the structures are visible, even when they are positioned behind another structure. Again, this has been done merely for purposes of illustration.

Figure 5:
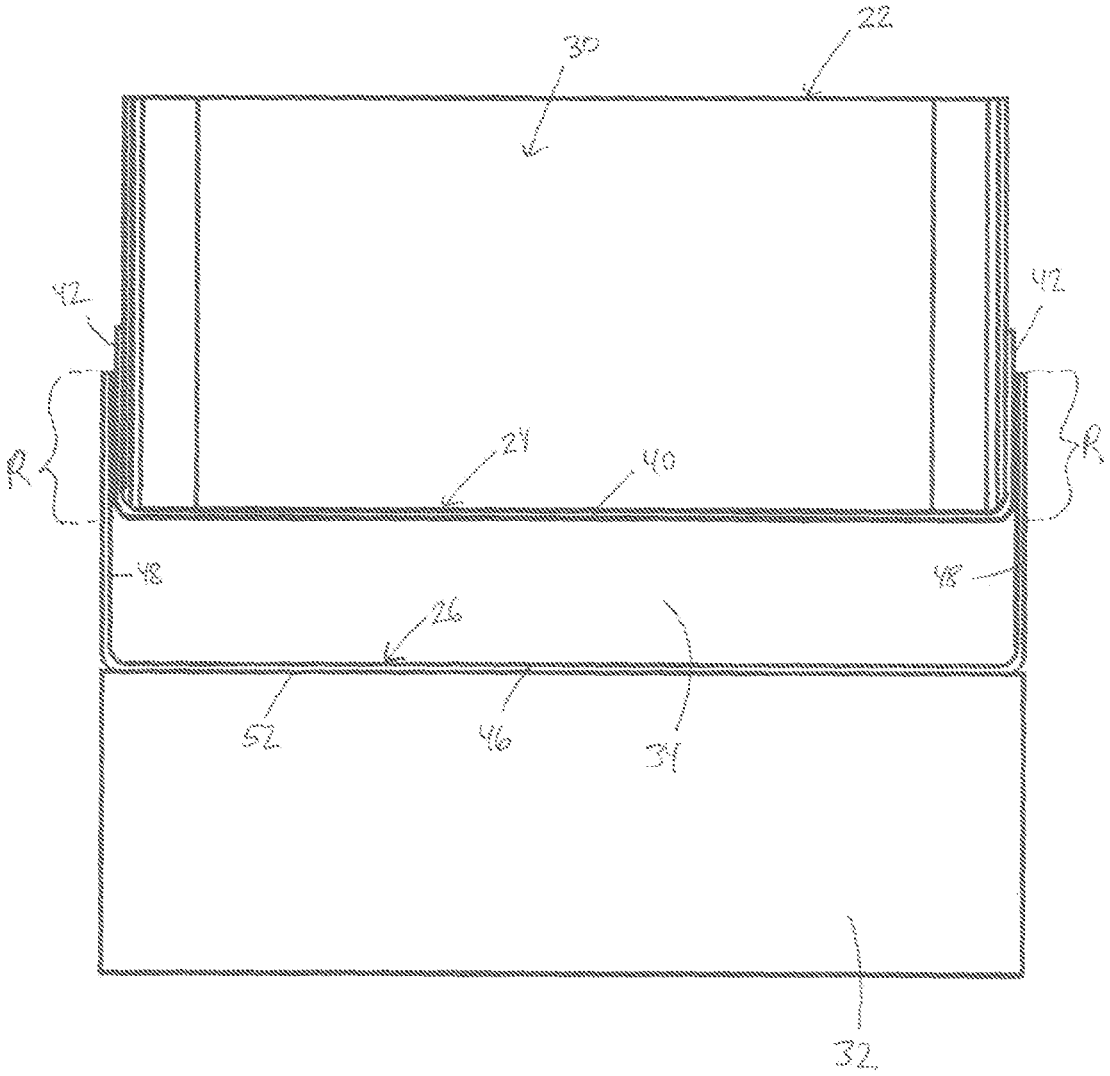
FIG. 5 is an enlarged view of the area labeled V in FIG. 4.

Prefabricated wall panel 22 includes a plurality of substantially vertical studs 36 that are spaced apart from each other and parallel to each other. A top plate 38 of wall panel 22 extends perpendicularly across the top 28 of wall panel 22 and is secured to the top end of each of the studs 36. Top plate 38 may be a conventional top plate. Upper sill plate 24 also extends perpendicularly across the bottom 30 of wall panel 22 and is secured to the bottom end of each of the studs 36. Upper sill plate 24, as can be seen more clearly in FIG. 5, is substantially U-shaped in cross section and includes a center flat member 40 and two end members 42. End members 42 are substantially vertical and parallel to each other. Flat member 40 is substantially perpendicular to end members 42 and extends horizontally between each end member 42.

Figure 2:
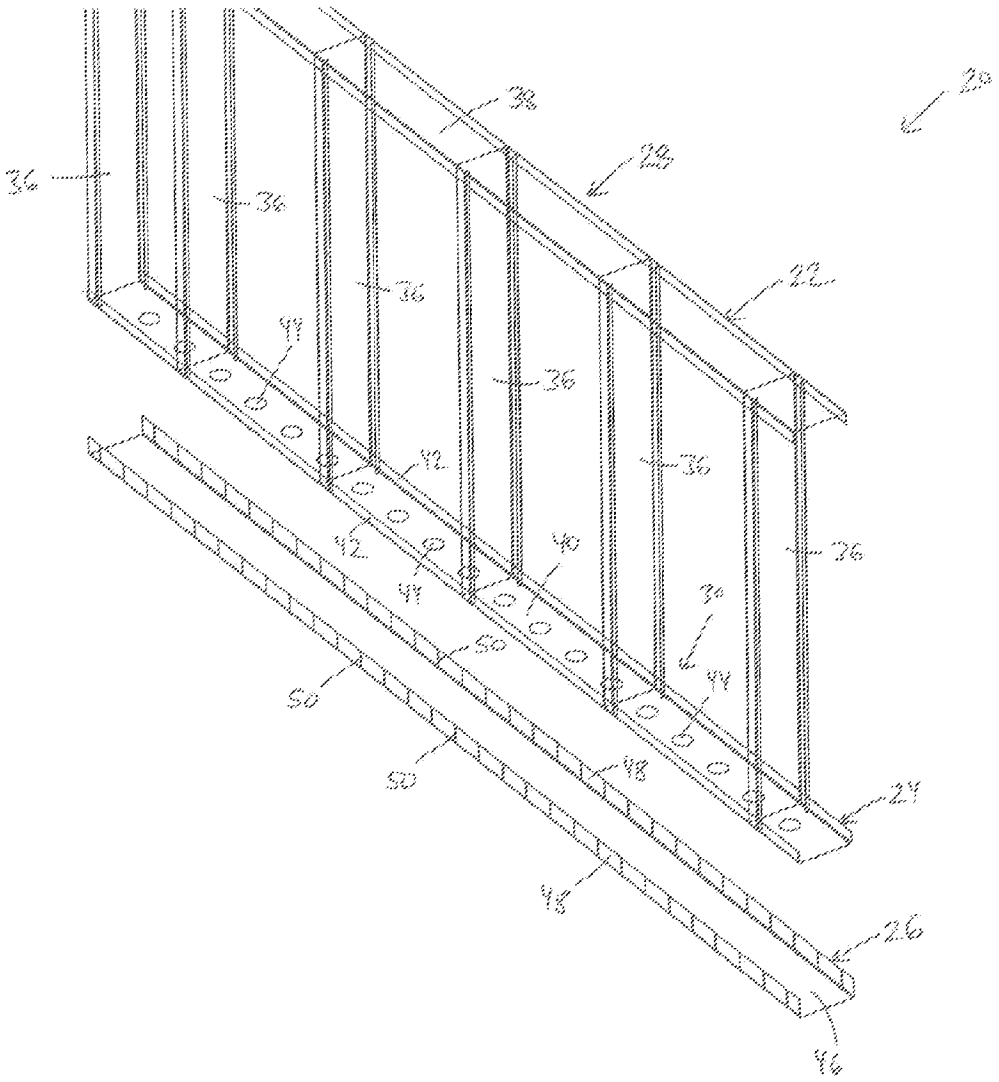
FIG. 2 is a perspective view of the wall leveling system of FIG. 1 shown with the foundation and grout removed for added clarity.

As can be seen more clearly in FIGS. 1 and 2, flat member 40 includes a plurality of apertures 44 defined in it that, as will be discussed in greater detail below, enable grout 34 to be more easily inserted between upper sill plate 24 and lower sill plate 26. Apertures 44 are shown in FIGS. 1 and 2 as being circularly shaped. It will be understood that the shape of apertures 44 can be changed. Further, the size of each aperture 44, as well as their spacing between each aperture 44, can be changed from that shown in FIGS. 1 and 2. In some alternative embodiments, upper sill plate 24 includes sections of expanded metal in areas between studs 36, and the holes in the expanded metal define apertures 44. Still other variations are possible.

As can also be seen more clearly in FIG. 5, lower sill plate 26 is also generally U-shaped in cross section and includes a central flat member 46 and two end members 48 defined at the ends of flat member 46. End members 48 extend substantially vertically upward from central flat member 46. As can also be seen more clearly in FIG. 5, end members 48 of lower sill plate 26 are spaced apart a slightly greater distance than end members 42 of upper sill plate 24 such that upper sill plate 24 can be inserted into lower sill plate 26. When so inserted, the interior sides of end members 48 of lower sill plate 26 contact a portion of the exterior sides of end members 42 of upper sill plate 24. More specifically, end members 48 overlap end members 42 in a region R (FIG. 5). The height of overlapping region R may vary from one end of lower sill plate 26 to its other, depending upon the levelness, or lack of levelness, of lower sill plate 26. As will be discussed in greater detail below, overlapping regions R provide an area where fasteners (not shown) can be inserted substantially horizontally through both end members 42 of upper sill plate 24 and end members 48 of lower sill plate 26, thereby securing upper and lower sill plates 24 and 26 together.

As can best be seen in FIGS. 1 and 2, lower sill plate 26 includes, in at least one embodiment, a plurality of substantially vertically oriented slits 50. Slits 50 are defined in end members 48. Slits 50 are provided in order to more easily allow lower sill plate 26 to bend and/or otherwise conform to a top surface 52 of foundation 32 when the top surface 52 is not straight. When lower sill plate 26 is not bent, slits 50 create very little to almost no gap in the end members 48. If top surface 52 of foundation 32 is bowed concavely downward (e.g. its ends are higher than its middle), the gaps created by slits 50 will become compressed when lower sill plate 26 is fastened to top surface 52. If top surface 52 of foundation 32 is bowed convexly upward (e.g. its ends are lower than its middle), then the gaps created by slits 50 will expand.

Each of upper and lower sill plates 24 and 26 are made of metal, such as, but not limited to, steel or aluminum, in at least one embodiment. Wall panel 22 (e.g. studs 36 and top plate 38, and upper sill plate 24), in at least one embodiment, is also made of metal, such as, but not limited to, steel or aluminum. In some embodiments, studs 36 and top plate 38 can be made of wood. Lower sill plate 26 can also be made of wood, in at least one alternative embodiment.

Figure 3:
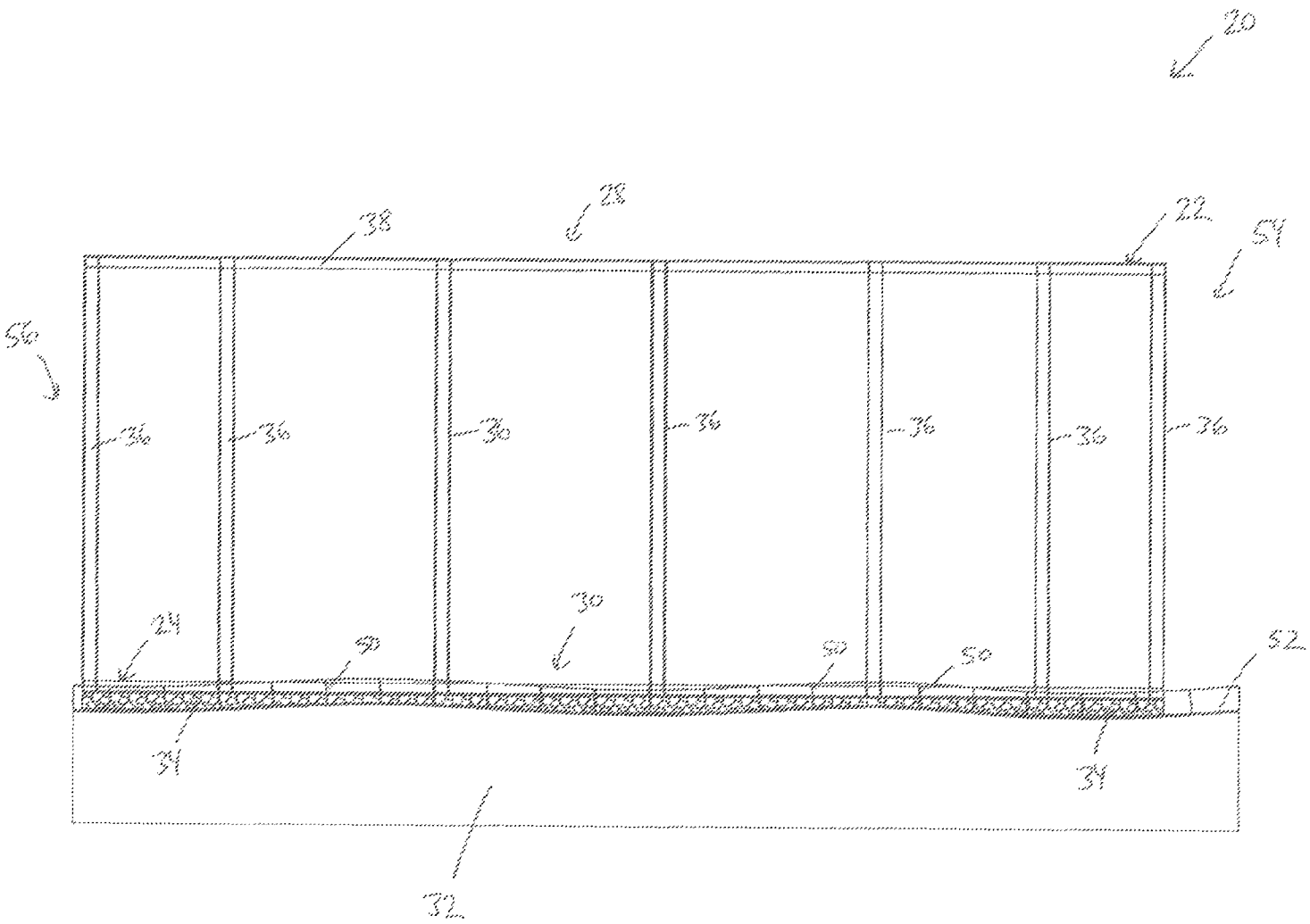
FIG. 3 is a front, elevation view of the wall leveling system of FIG. 1.
Figure 4:
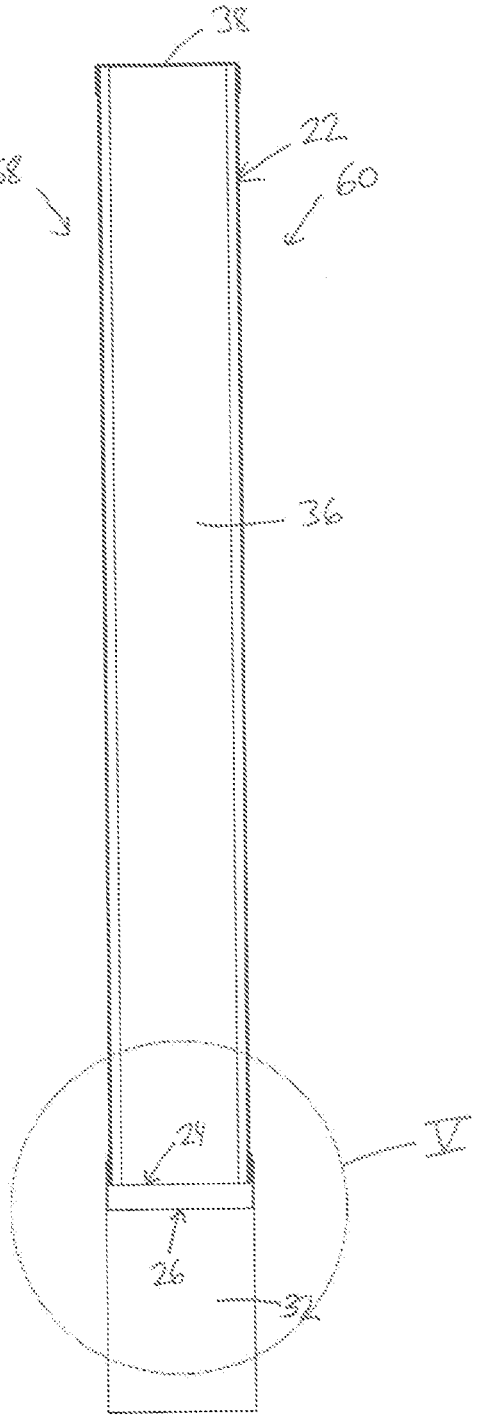
FIG. 4 is an end, elevation view of the wall leveling system of FIG. 1.

Wall leveling system 20 is designed to account for and correct any lack of levelness or straightness in top surface 52 of foundation 32. In other words, system 20 is designed to ensure that wall panel 22 is installed in a level manner, even if top surface 52 may not be level or straight. Further, system 20 is designed to ensure that wall panel 22 is level in both its side-to-side direction, as well as its front to back direction. This side-to-side leveling can be understood more easily with reference to FIG. 3. System 20 is designed to ensure that after wall panel 22 is installed, it will have the same height at a first end 54 as its second end 56, even if the height of top surface 52 of foundation 32 at first end 54 is not the same as the height of top surface 52 of foundation 32 at second end 56. The front-to-back leveling can be understood more easily with respect to FIG. 4. As shown in FIG. 4, system 20 is designed to also ensure that after wall panel 22 is installed, the height of wall panel 22 at a front end 58 will be that same as its height at a back end 60, even if the height of the top surface 52 at its front and back ends 58 and 60 is not the same.

In order to use wall leveling system 20, a user first fastens lower sill plate 26 to top surface 52 of foundation 32. This may be done in any suitable and/or conventional manner, such as by inserting a plurality of fasteners substantially vertically through flat member 40 of lower sill plate 26 and into foundation 32. Because of the ability of lower sill plate 26 to bend and/or flex, the attachment of lower sill plate 26 to foundation 32 will cause lower sill plate 26 to generally match the shape of top surface 52 of foundation 32. Thus, for example, if top surface 52 includes a plurality of undulations in a side to side direction (e.g. from first end 54 to second end 56), such as is shown in the example of FIG. 3, lower sill plate 26 will generally be shaped to include those same undulations and/or lack of levelness after it is fastened to foundation 32.

Once lower sill plate 26 is fastened to foundation 32, wall panel 22 is inserted into lower sill plate 26. More specifically, upper sill plate 24 of wall panel 22 is inserted into lower sill plate 26. Before wall panel 22 is fastened to anything, it is leveled. Once it is leveled, the builders (or other workers) temporarily and manually hold wall panel 22 in this level state using conventional tools until it can be secured to lower sill plate 26 in this level state. As mentioned previously, one method of securing upper sill plate 24 to lower sill plate 26 is to drive a plurality of fasteners substantially horizontally through end members 48 and 42 in those areas where they overlap (e.g. overlapping region R of FIG. 5). After upper plate 24 has been secured to lower sill plate 26 in this manner, or another manner, the temporary tools used by the workers to hold wall panel 22 in a level state can be removed. When removed, wall panel 22 will be level even if lower sill plate 26 is not level because wall panel 22 was fastened to lower sill plate 26 in a level manner. To the extent lower sill plate 26 was not level or even, one or more gaps will be defined between the flat member 46 of lower sill plate 26 and flat member 40 of upper sill plate 24. Such gaps are then filled in using grout 34.

In an alternative embodiment, upper sill plate 24 does not have a U-shape when viewed from its ends. Instead, in one such alternative embodiment, upper sill plate 24 has a rectangular block shape with a substantially flat top, flat bottom, and flat sides. The height of the block is large enough to allow fasteners inserted through the end members 48 of the lower sill plate 26 in the overlapping region R to engage the material of the upper sill plate 24 so that the two sill plates can be fastened together. In still another alternative embodiment, upper sill plate 24 is substantially flat and thin. In this embodiment, the upper sill plate 24 and lower sill plate 26 may be secured together by inserting fasteners through the end members 48 of lower sill plate 26 into one or more of the studs 36.

In yet another alternative embodiment, top plate 38 may be modified to include one or more apertures similar to apertures 44 of upper sill plate 24. Such apertures are sized sufficiently large to allow a builder to insert one or more hooks, or other devices, therethrough. The inserted hook, or other device, is then rotated after being inserted so as to prevent it from being removed from the aperture. The hook is attached to a rope, cable, chain, or the like, which is then used to lift the wall panel 22 into position above foundation 32 and into lower sill plate 26. After the wall panel 22 is leveled and its upper sill plate 24 is fastened to lower sill plate 26, the inserted hooks, or other devices, can be removed from wall panel 22. Alternatively, the hooks can remain in the apertures and help hold the wall panel 22 in place until the grout is inserted and/or cured. Regardless of when the hooks are removed, the provisioning of apertures in the top plate 38 helps ease the task of lifting and maintaining the wall panel 22 in its desired position prior to its being secured therein with fasteners and grout.

The insertion of grout between upper and lower sill plates 24 and 26 is easily accomplished through the use of apertures 44. That is, the grout is inserted through as many of apertures 44 as necessary in order to position the grout in those areas where a gap exists between upper and lower sill plates 24 and 26. Further, the end members 48 of lower sill plate 26 substantially prevent the grout from leaking out of these gaps prior to the grout curing. That is, the end members 48 act as barriers for the grout 34, thereby retaining the grout 34 in the gaps between flat members 40 and 46 of upper and lower sill plates 24 and 26. Once the grout has cured, installation of wall panel 22 is complete. The cured grout then bears the majority of the weight of the wall panel 22 (and all of the structures it supports), rather than the fasteners used to secure upper sill plate 24 to lower sill plate 26 (e.g. those inserted through overlapping regions R). It is therefore not incumbent upon the fasteners used to secure sill plates 24 and 26 together to bear the weight of the structures supported on the wall panel 22.

Various alterations and changes can be made to the above-described embodiments without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

What is claimed is:

1. A method of installing a prefabricated wall panel on top of a foundation comprising:
   - fastening a lower sill plate to a top of the foundation;
   - inserting the prefabricated wall panel into the lower sill plate;
   - leveling the prefabricated wall panel;
   - fastening the prefabricated wall panel to the lower sill plate while the prefabricated wall panel is level; and
   - inserting grout through one or more openings in a bottom of the prefabricated wall panel between a bottom of the prefabricated wall panel and a top of the lower sill plate.

2. The method of claim 1 further comprising:
   - fastening an upper sill plate to the bottom of the prefabricated wall panel prior to inserting the prefabricated wall panel into the lower sill plate.

3. The method of claim 1 wherein the fastening of the lower sill plate to the top of the foundation includes bending the lower sill plate to match any unevenness or lack of levelness of the top of the foundation.

4. The method of claim 3 wherein the lower sill plate has a generally U-shaped cross section comprised of a horizontal member and two end members, and the end members include a plurality of generally vertical slits adapted to allow the lower sill plate to bend to match any unevenness of the top of the foundation.

5. The method of claim 2 wherein the prefabricated wall panel includes an upper sill plate.

6. The method of claim 5 wherein the step of fastening the prefabricated wall panel to the lower sill plate while the prefabricated wall panel is level includes inserting fasteners through a first vertical wall member of the lower sill plate and through a second vertical wall member of the upper sill plate.

7. The method of claim 6 wherein the upper and lower sill plates are both generally U-shaped and both include a generally horizontal member and two end members, wherein a first one of the end members of the upper sill plate defines the first vertical wall member, and a second one of the end members of the lower sill plate defines the second vertical wall member.

* * * * *